US011140978B1

(12) United States Patent
Baker

(10) Patent No.: US 11,140,978 B1
(45) Date of Patent: Oct. 12, 2021

(54) ATTACHABLE TABLE LEG APPARATUS

(71) Applicant: Table Transform, LLC, Scottsdale, AZ (US)

(72) Inventor: Benjamin Scott Baker, Scottsdale, AZ (US)

(73) Assignee: Table Transform, LLC, Scottsdale, AZ (US)

( * ) Notice: Subject to any disclaimer, the term of this patent is extended or adjusted under 35 U.S.C. 154(b) by 239 days.

(21) Appl. No.: 16/675,557

(22) Filed: Nov. 6, 2019

(51) Int. Cl.
*A47B 13/02* (2006.01)
*A47B 96/20* (2006.01)

(52) U.S. Cl.
CPC ..... *A47B 13/02* (2013.01); *A47B 96/20* (2013.01)

(58) Field of Classification Search
CPC ..... A47B 13/02; A47B 96/20; A47B 3/06; A47B 91/00; A47B 9/20; A47B 9/00
USPC ..... 248/188.8
See application file for complete search history.

(56) References Cited

U.S. PATENT DOCUMENTS

| | | | | |
|---|---|---|---|---|
| 3,846,211 A | | 11/1974 | Beaumier et al. | |
| 5,060,896 A | | 10/1991 | Hobbins | |
| 5,163,373 A | | 11/1992 | Anderson et al. | |
| 5,333,825 A | | 8/1994 | Christensen | |
| 5,394,809 A | * | 3/1995 | Feldpausch | A47B 9/00 108/147.21 |
| 5,603,140 A | * | 2/1997 | Pryce | E04F 19/028 16/18 CG |
| 5,673,882 A | * | 10/1997 | Huang | A47B 17/00 108/158.11 |
| 6,213,452 B1 | * | 4/2001 | Pettit | E04F 11/1812 248/188.8 |
| 6,523,795 B2 | | 2/2003 | Gutgsell et al. | |
| 7,392,966 B1 | * | 7/2008 | Chen | A47B 91/00 248/188.8 |
| 8,794,576 B2 | * | 8/2014 | Tsai | A47B 13/02 248/188.8 |
| 10,028,576 B1 | * | 7/2018 | Yao | A47B 21/06 |
| 2001/0032913 A1 | * | 10/2001 | Gutgsell | A47B 21/06 248/188.1 |
| 2005/0028711 A1 | | 2/2005 | Neunzert et al. | |
| 2007/0221800 A1 | | 9/2007 | Levin | |

(Continued)

FOREIGN PATENT DOCUMENTS

| | | | |
|---|---|---|---|
| EP | 1787546 A1 * | 5/2007 | A47B 91/00 |
| JP | 2007325809 A | 12/2007 | |

OTHER PUBLICATIONS

Bizchair.com, Hercules Series Table, Retrieved from the Internet: https://www.bizchair.com/XA-F-96X40-GG.html?kpid=go_cmp-210092765_adg-45742057126_ad-224400938561_pla-390776003034_dev-c_ext-_prd-XA-F-96X40-GG&utm_campaign=%5BPLA%5DBizchair-GGProducts&gclid=EAlalQobChMI6Pebk7Hs5AIVYSCtBh0Umg-EAQYCSABEgJlvfD_BwE [downloaded on Sep. 25, 2019], Jan. 1, 2019,4 pages.

(Continued)

*Primary Examiner* — Daniel J Rohrhoff
(74) *Attorney, Agent, or Firm* — Adam R. Stephenson, Ltd.

(57) ABSTRACT

An attachable table leg apparatus is disclosed. Specific implementations of a table leg apparatus may include a first portion including a plurality of recesses. The plurality of recesses may be configured to receive a table support. The table support may include a first table leg and a second table leg. The table leg apparatus may also include a second portion configured to removably couple over the first portion. The first portion and the second portion may also fully enclose the first table leg and the second table leg of the table support.

20 Claims, 11 Drawing Sheets

(56) References Cited

U.S. PATENT DOCUMENTS

| | | | | |
|---|---|---|---|---|
| 2013/0000529 | A1 | 1/2013 | Heyring et al. | |
| 2013/0036950 | A1 | 2/2013 | Heyring et al. | |
| 2014/0090582 | A1 | 4/2014 | Grace | |
| 2015/0164218 | A1* | 6/2015 | Bonuccelli | A47B 9/20 108/147.19 |
| 2018/0084902 | A1* | 3/2018 | Dashti | A47B 3/10 |
| 2018/0279767 | A1 | 10/2018 | Dunker | |
| 2019/0254417 | A1 | 8/2019 | McKsymick | |

OTHER PUBLICATIONS

Eventstable, EventStable Table, Retrieved from the Internet: https://www.eventstable.com/8-x-40-solid-pine-folding-farm-table.html?gsfid=1&gclid=EAIaIQobChMI6Pebk7Hs5AIVYSCtBhOUmg-IEAQYAiABEgIWvfD_BwE [downloaded on Sep. 25, 2019], Jan. 1, 2019, 1 page.

Coast To Coast, CTC Table, Retrieved from the Internet: https://ctceventfurniture.com/farmhouse-tables/barn-wood-brown-farmhouse-table-40-in-x-84-in-ftfl-4084-ba/?kpid=go_cmp-1380257960_adg-56461052138_ad-267278439595_pla-789357184274_devc_ext-_prd-FTFL-4084-BA&utm_campaign=%5BPLA%5D%20General_Folding_Chairs_Shopping&gclid=EAIaIQobChMI6Pebk7Hs5AIVYSCtBhOUmg-IEAQYAyABEgJKg_D_BwE [downloaded on Sep. 25, 2019], Jan. 1, 2019, 2 pages.

* cited by examiner

ATTACHABLE TABLE LEG APPARATUS

BACKGROUND

1. Technical Field

Aspects of this document relate generally to a mechanically attachable apparatus for a table. More specific implementations involve an apparatus configured to attach to a table support.

2. Background

There are several types of folding tables and banquet-style tables. The tables may include an upper surface supported by a lower table support. The table supports of these tables may include table legs.

SUMMARY

Implementations of a table leg apparatus may include a first portion including a plurality of recesses. The plurality of recesses may be configured to receive a table support. The table support may include a first table leg and a second table leg. The table leg apparatus may also include a second portion configured to removably couple over the first portion. The first portion and the second portion may also fully enclose the first table leg and the second table leg of the table support.

Implementations of a table leg apparatus may include one, all, or any of the following:

The table leg apparatus may include a third portion configured to cover a bridge of the table support.

The location of the plurality of recesses of the first portion may correspond to a shape of the table support.

The shape of the table support may be one of an A-frame, X-frame, H-frame, ladder-frame, or box-frame.

A shape of the second portion may correspond with a shape of the plurality of recesses of the first portion.

The second portion of the table leg apparatus may be configured to hingedly couple to the first portion.

The second portion of the table leg apparatus may be configured to removably couple to the first portion using a tongue and groove system.

Implementations of a table leg apparatus may include a first portion including a plurality of cavities. The plurality of cavities may be configured to receive a table support. The table support may include a first table leg and a second table leg. The table leg apparatus may include a first bottom portion configured to receive a first foot of the first table leg, and a second bottom portion configured to receive a second foot of the second table leg. The table leg apparatus may include a second portion configured to removably couple over the first portion. The first portion and the second portion may enclose the first table leg and the second table leg of the table support.

Implementations of a table leg apparatus may include one, all, or any of the following:

The table leg apparatus may include a third portion configured to enclose a bridge of the table support.

A location of the plurality of cavities of the first portion may correspond to a shape of the table support.

The shape of the table support may be one of an A-frame, X-frame, H-frame, ladder-frame, or box-frame.

A shape of the second portion of the table leg apparatus may correspond with a shape of the plurality of cavities of the first portion.

The second portion of the table leg apparatus may be configured to hingedly couple to the first portion.

The second portion of the table leg apparatus may be configured to removably couple to the first portion using a tongue and groove system.

Implementations of a table leg apparatus may include a first portion including a plurality of recesses. The plurality of recesses may be configured to receive a table support. The table support may include a first table leg and a second table leg. The table leg apparatus may also include a second portion comprising one or more notches. The one or more notches may be configured to couple around the table support. The second portion may be configured to removably couple over the first portion. The first portion and the second portion may also fully enclose the first table leg and the second table leg of the table support.

Implementations of a table leg apparatus may include one, all, or any of the following:

A location of the plurality of recesses of the first portion may correspond to a shape of the table support.

The shape of the table support may be one of an A-frame, X-frame, H-frame, ladder frame, or box-frame.

A shape of the second portion of the table leg apparatus may correspond with a shape of the plurality of recesses of the first portion.

The second portion of the table leg apparatus may be configured to hingedly couple to the first portion.

The second portion of the table leg apparatus may be configured to removably couple to the first portion using a tongue and groove system.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended attachable table leg apparatus will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such attachable table leg apparatus, and implementing components and methods, consistent with the intended operation and methods.

Figure 1:
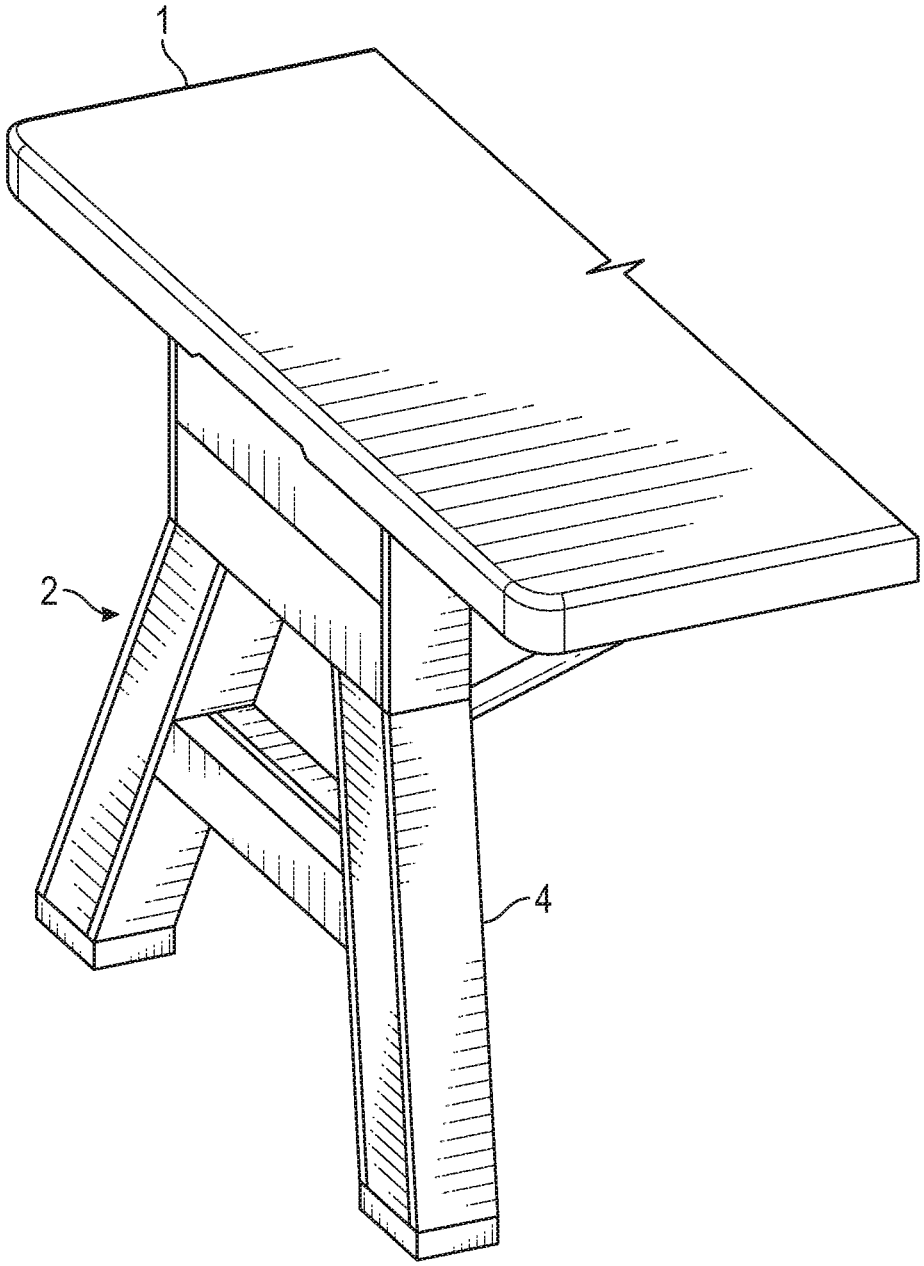
FIG. 1 is an implementation of a table leg apparatus.

Referring to FIG. 1, an implementation of a table leg apparatus is illustrated. The table leg apparatus 2 is configured to attach onto, and detach from, a table support of a table 1. In one implementation, the table 1 may be a banquet-style folding table, though the table 1 may be of any type or design. A first portion 4 of the table leg apparatus 2 is illustrated. In various implementations, the table leg apparatus 2 may be configured to fit over, or couple around, a shape of the table support of the table 1. In such implementations, the shape of the table support may be one of an A-frame, an X-frame, an H-frame, a ladder-frame, a box-frame, or any other type of table support, by non-limiting example. The table leg apparatus 2 depicted in FIG. 1 assumes an A-frame table support type, for illustrative purposes only. It should be understood that the table leg apparatus may be of any type or configuration to suit the variety of table support types contemplated by one of ordinary skill, with each configuration including similar elements.

Figure 2:
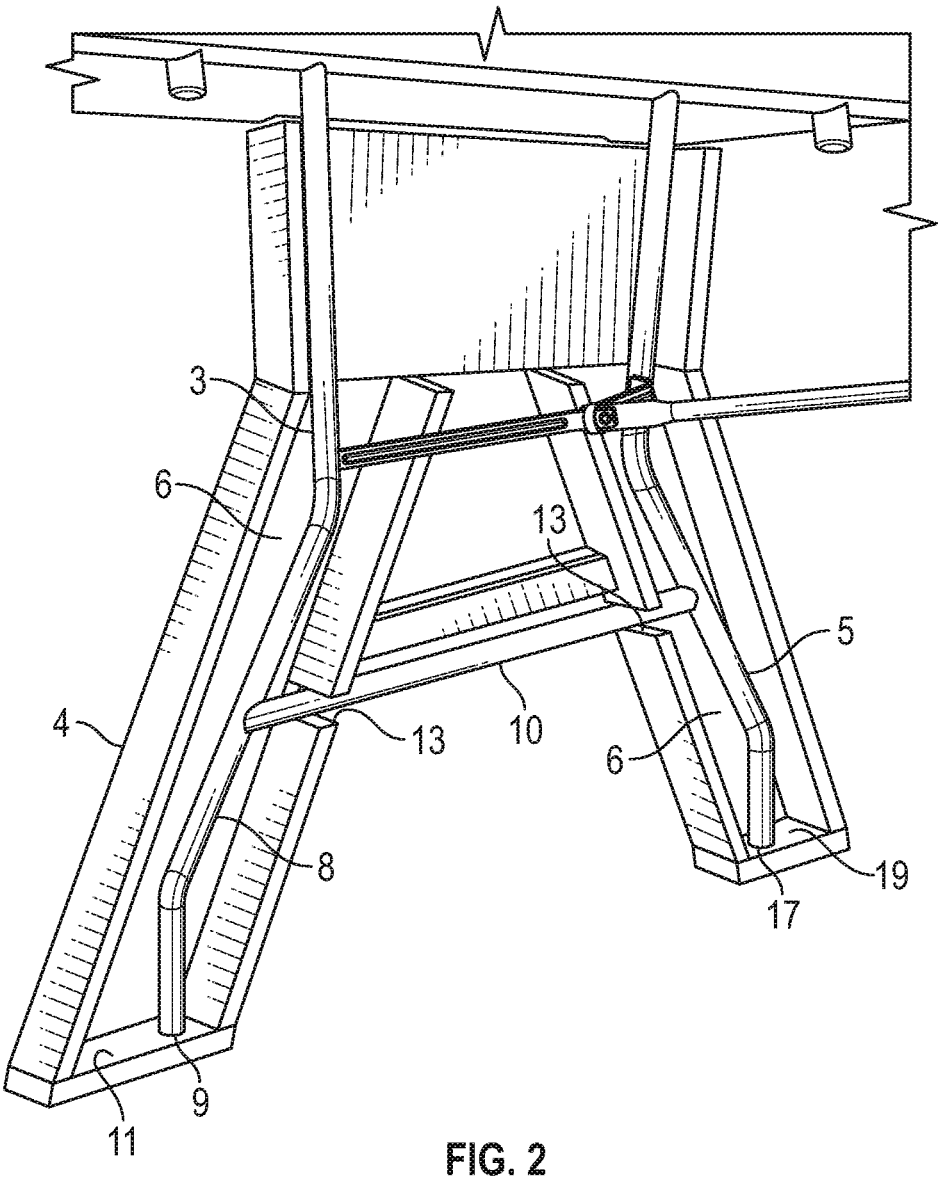
FIG. 2 is an inside view of a first portion of the table leg apparatus of FIG. 1.

Referring to FIG. 2, an inside view of a first portion of the table leg apparatus of FIG. 1 is illustrated. The table leg apparatus includes the first portion 4, as illustrated. The first portion 4 includes a plurality of recesses 6, or cavities. As illustrated, the plurality of recesses 6 are configured to receive a table support 3. As illustrated, the table leg support 3 includes a first table leg 8 and a second table leg 5. As illustrated, the recesses 6 of the first portion 4 are configured to fit snugly around the table support 3. As illustrated, a location of the plurality of recesses 6 of the first portion 4 correspond to a shape of the table support 3. In other various implementations, the recesses 6 of the first portion 4 may be configured to include enough space to accommodate, and receive, various differently configured table supports, with regard to their size, shape, and configuration. As illustrated, a first foot 9 of the first table leg 8 rests within the recesses 6 of the first portion 4, and on top of a first bottom portion 11 of the first portion 4. Similarly, a second foot 17 of the second table leg 5 rests within the recesses 6 of the first portion 4, and on top of a second bottom portion 19 of the first portion 4. As illustrated, the first portion 4 also includes one or more openings 13 that accommodate a bridge 10 of the table support 3, allowing the first portion 4 to fit or couple around the bridge 10. In various implementations, the bridge 10 may be a horizontal bar extending from the first table leg 8 to the second table leg 5.

Figure 3:
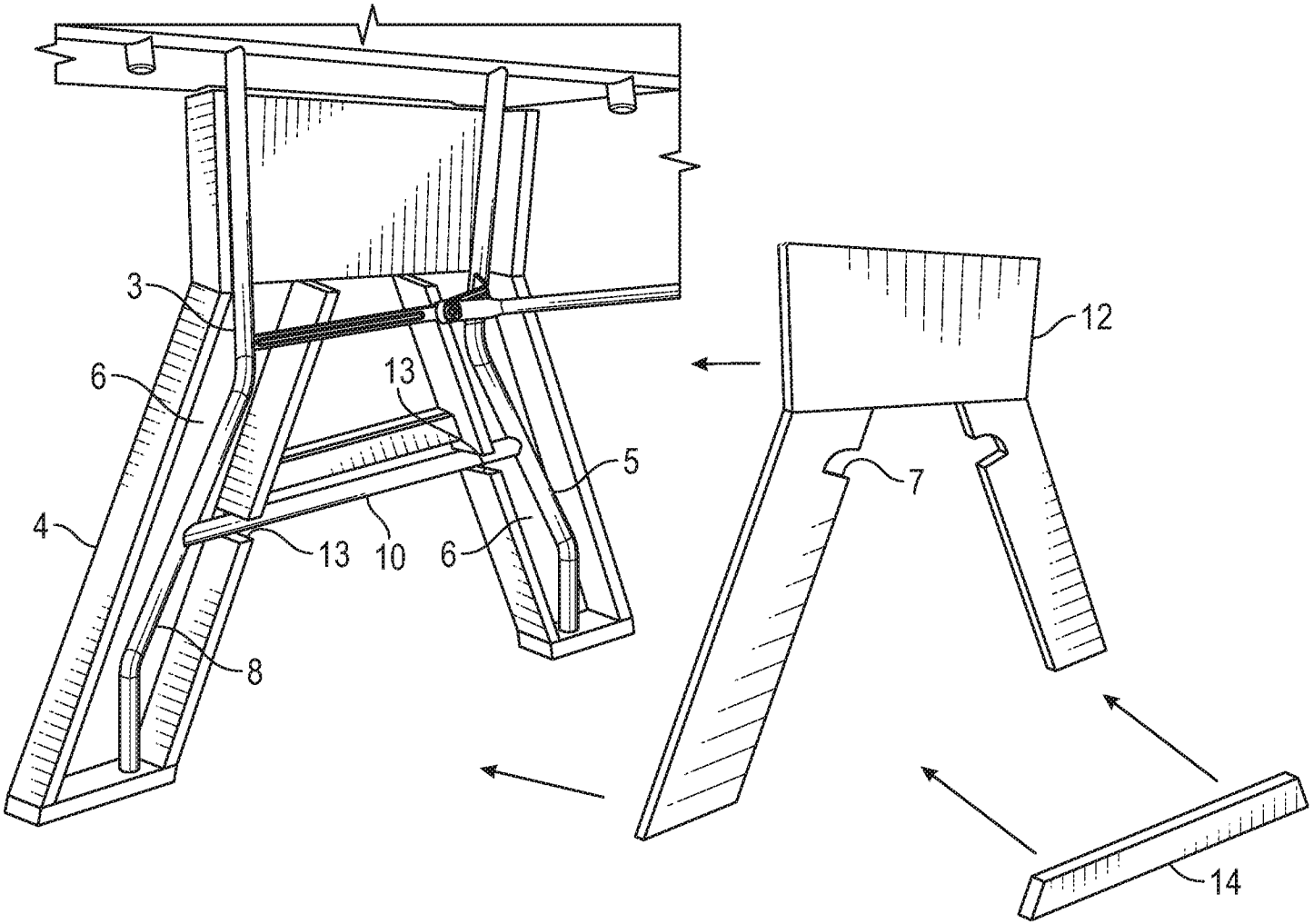
FIG. 3 is a back-side view of the implementation of the table leg apparatus of FIG. 1, showing a second portion and a third portion of the table leg apparatus.

Referring to FIG. 3, a back-side view of the implementation of the table leg apparatus of FIG. 1, showing a second portion and a third portion of the table leg apparatus, is illustrated. As illustrated, the table leg apparatus includes a second portion 12. As illustrated, a shape of the second portion 12 corresponds with a shape of the plurality of recesses 6 of the first portion 4. As illustrated, the second portion 12 includes one or more notches 7. In various implementations, the one or more notches 7 may be configured to couple around the table support 3. As illustrated, the second portion 12 is configured to couple to the first portion 4. In various implementations, the first portion 4 and the second portion 12 may be configured to removably couple to each other, and to readily attach and detach from each other to secure or to separate the table leg apparatus to or from the table support 3. As illustrated, the first table leg 8 and the second table leg 5 rest within the recesses 6 of the first portion 4, as the front portion 4 is configured to receive the table support 3 that includes the first table leg 8 and the second table leg 5. As illustrated, the first portion 4 includes the one or more openings 13 that accommodate the bridge 10 of the table support 3. As illustrated, the table leg apparatus may also include a third portion 14 configured to cover the bridge 10 of the table support 3, in various implementations. In such implementations, the third portion 14 may be configured to couple to either or both of the first portion 4 or the second portion 12, or it may be configured to couple directly to the bridge 10. In such implementations, the third portion 14 may include hinges, clips, screws, nails, tongues and grooves, notches, or any other attachment means, by non-limiting example, to secure it to either or both of the first portion and/or second portion, or to the bridge 10. In other various implementations, the third portion may not be included, which may leave the bridge 10 uncovered or partially uncovered. In other various implementations, the third portion may be fixedly coupled to the first portion or to the second portion, and may not be a separate piece.

Figure 4:
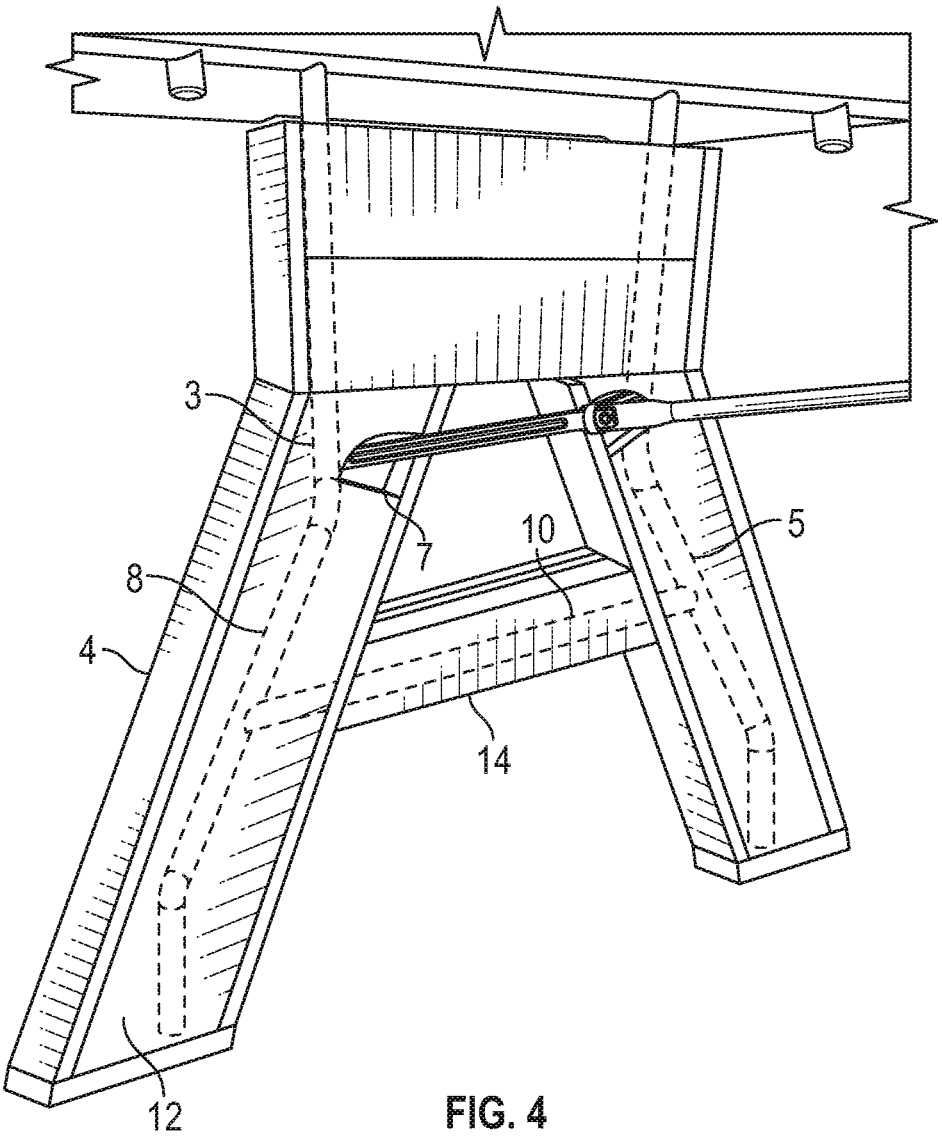
FIG. 4 is a back-side view of the implementation of the table leg apparatus of FIG. 1, showing a table support enclosed within the table leg apparatus.

Referring to FIG. 4, a back-side view of the implementation of the table leg apparatus of FIG. 1, showing a table support enclosed within the table leg apparatus, is illustrated. As illustrated, the second portion 12 is coupled to a back side of the first portion 4, and the first portion 4 and the second portion 12 fully enclose the table support 3, which table support 3 includes a first table leg 8 and a second table leg 5. In various implementations, the first portion 4 and the second portion 12 may enclose the first table leg of the table support, the second table leg of the table support, and/or the entire table support 3. In still other implementations, the first portion 4 and the second portion 12 may be configured to removably couple around the table support 3. In such implementations, the first portion 4 and the second portion 12 may attach or detach from the table support 3 as separate pieces, or as one connected piece, the first portion 4 and the second portion 12 being coupled together. As illustrated, the third portion 14 may couple over the bridge 10.

Figure 5:
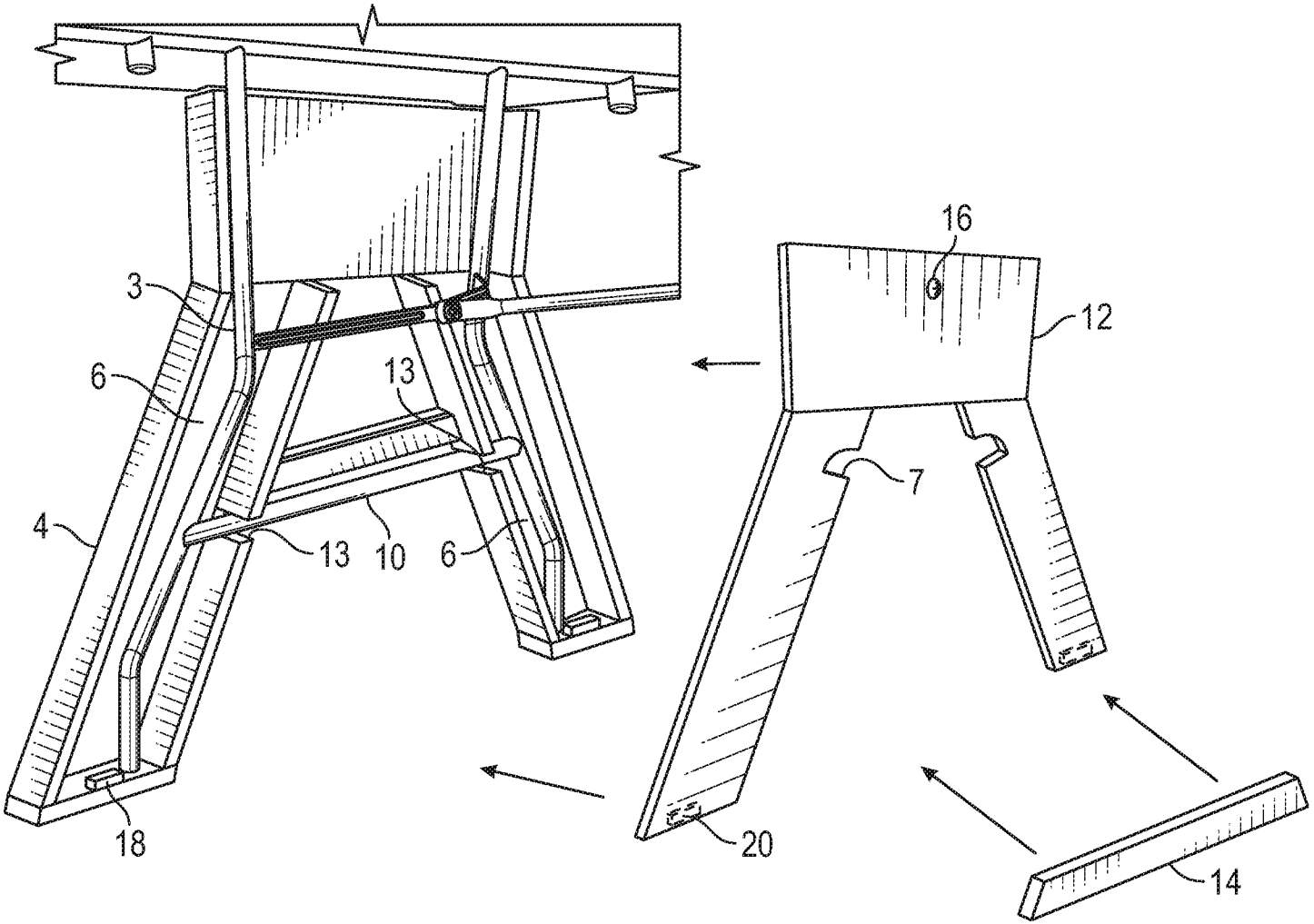
FIG. 5 is a back-side view of the implementation of the table leg apparatus of FIG. 1, showing a tongue and groove system.

Referring to FIG. 5, a back-side view of the implementation of the table leg apparatus of FIG. 1, showing a tongue and groove system, is illustrated. The table support 3 is fit within the recesses 6 of the front portion 4, as illustrated. In such implementations, as previously described, the first portion 4 includes the one or more openings 13 that couple around the bridge 10. In addition, as illustrated, the table leg apparatus may also include the third portion 14 configured to cover a back side of the bridge 10 of the table support 3, in various implementations. Furthermore, the one or more notches 7 of the second portion 12 may be configured to couple around the table support 3. As illustrated, and in various implementations, the first portion 4 may be configured to removably couple to the second portion 12 using a tongue and groove system, with a tongue 18 included in one or more recesses of the plurality of recesses 6 of the first portion 4, and with one or more grooves 20 included in the second portion 12, to correspond in size, shape, and placement with each tongue 18. In various implementations, the second portion 12 may also include a fastener 16 to secure a top portion of the second portion 12 to a top portion of the first portion 4. In such implementations, the fastener may be a clip, snap, screw, nail, hinge, tongue and groove, or any other such fastener, by non-limiting example. In other implementations, the fastener 16 may not be included. In still other implementations, the first portion 4, second portion 12, and third portion 14 may also be coupled together by clips, snaps, screws, nails, hinges, or any other such coupling means, by non-limiting example.

The disclosed table leg apparatus may also be configured to fit, enclose, or accommodate various shapes and structures of table supports. As previously disclosed, a location of a plurality of recesses of a first portion of the table leg apparatus may be configured to correspond to a shape of a table support. And, a shape of a second portion of the table leg apparatus may be configured to correspond with a shape of the plurality of recesses of the first portion of the table leg apparatus.

Figure 6:
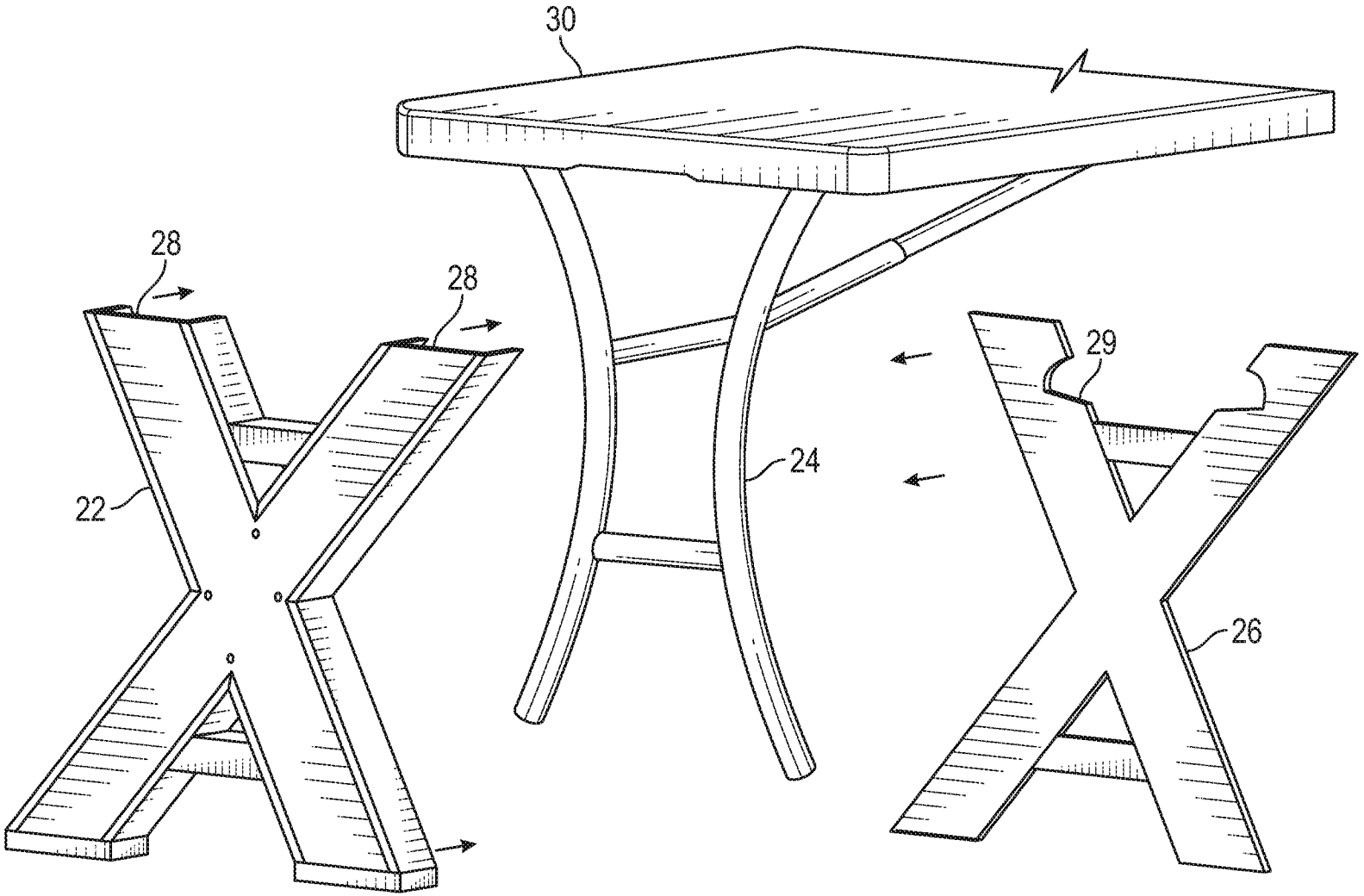
FIG. 6 is an implementation of the table leg apparatus in an X-frame configuration.

Referring to FIG. 6, an implementation of the table leg apparatus in an X-frame configuration is illustrated. The table leg apparatus includes a first portion 22, as illustrated. In various implementations, a plurality of recesses 28, or cavities, of the first portion 22 may correspond to the shape of a table support 24 of a table 30. For exemplary purposes, an X-frame shape of the table support 24 and the first portion 22 is illustrated in FIG. 6, though the recesses 28 may correspond to any shape of table support. As illustrated, the plurality of recesses 28 may be configured to receive the table support 24. As illustrated, a second portion 26 may be configured to removably couple over the first portion 22, by any of the means previously described, and the first portion 22 and the second portion 26 may fully or partially enclose the table support 24. As illustrated, the second portion 26 may also include one or more notches 29 configured to couple around the table support 24.

Figure 7:
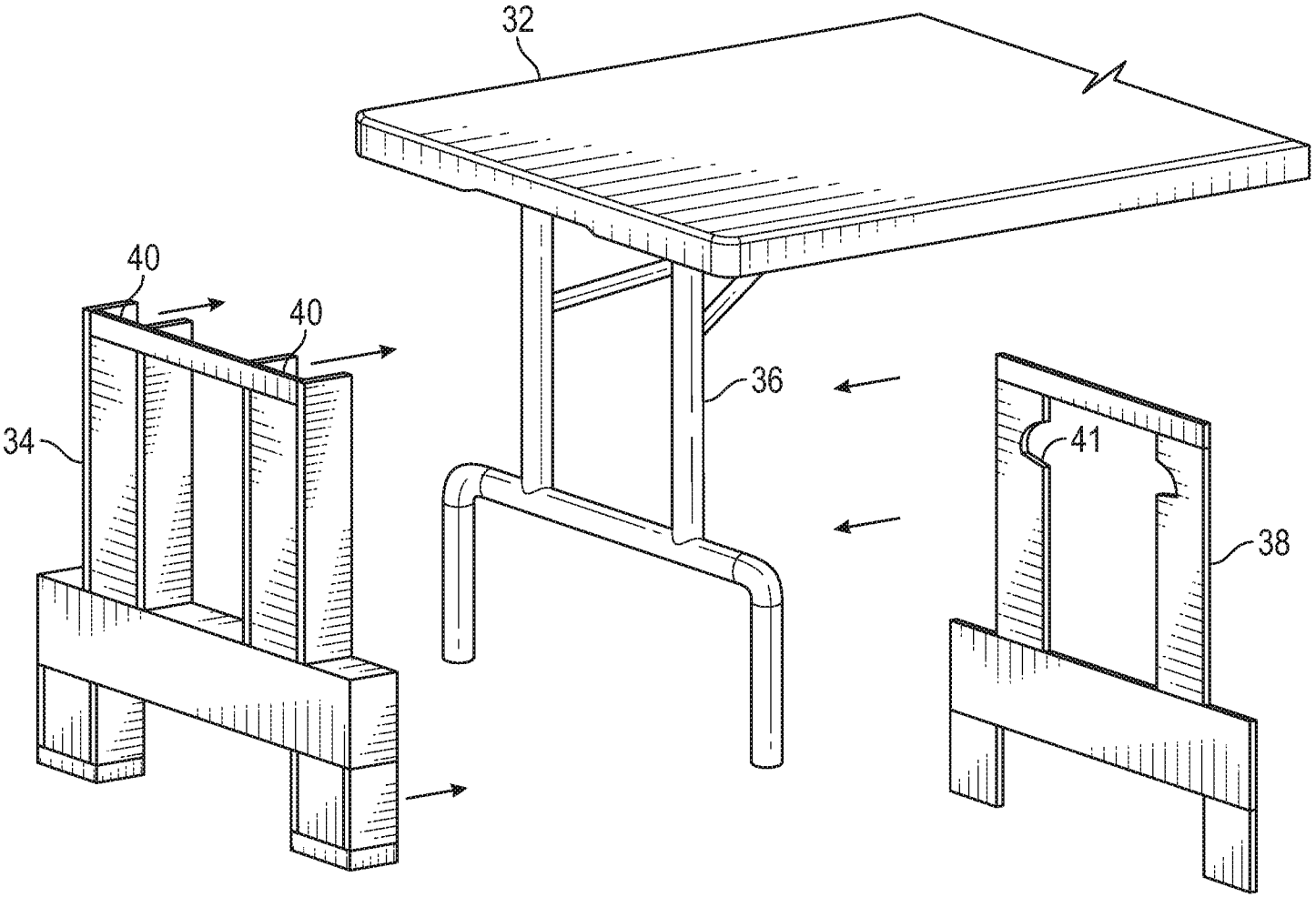
FIG. 7 is an implementation of the table leg apparatus in an H-frame configuration.

Referring to FIG. 7, an implementation of the table leg apparatus in an H-frame configuration is illustrated. The table leg apparatus includes a first portion 34, as illustrated. In various implementations, a plurality of recesses 40, or cavities, of the first portion 34 may correspond to the shape of a table support 36 of a table 32. For exemplary purposes, an H-frame shape of the table support 36 and the first portion 34 is illustrated in FIG. 7, though the recesses 40 may correspond to any shape of table support. As illustrated, the plurality of recesses 40 may be configured to receive the table support 36. As illustrated, a second portion 38 may be configured to removably couple over the first portion 34, by any of the means previously described, and the first portion 34 and the second portion 38 may fully or partially enclose the table support 36. As illustrated, the second portion 38 may also include one or more notches 41 configured to couple around the table support 36.

Figure 8:
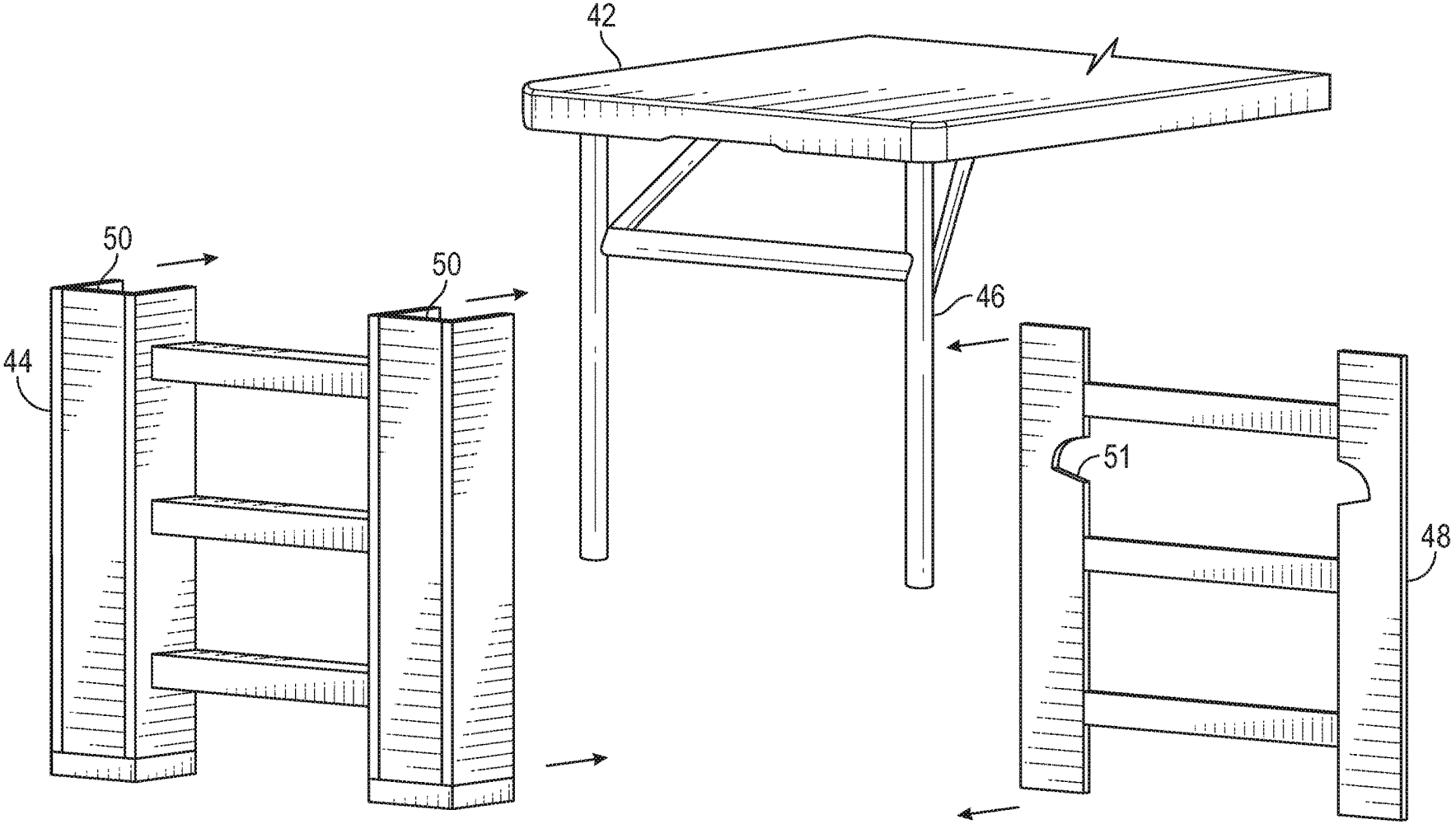
FIG. 8 is an implementation of the table leg apparatus in a ladder-frame configuration.

Referring to FIG. 8, an implementation of the table leg apparatus in a ladder-frame configuration is illustrated. The table leg apparatus includes a first portion 44, as illustrated. In various implementations, a plurality of recesses 50, or cavities, of the first portion 44 may correspond to the shape of a table support 46 of a table 42. For exemplary purposes, a ladder-frame shape of the table support 46 and the first portion 44 is illustrated in FIG. 8, though the recesses 50 may correspond to any shape of table support. As illustrated, the plurality of recesses 50 may be configured to receive the table support 46. As illustrated, a second portion 48 may be configured to removably couple over the first portion 44, by any of the means previously described, and the first portion 44 and the second portion 48 may fully or partially enclose the table support 46. As illustrated, the second portion 48 may also include one or more notches 51 configured to couple around the table support 46.

Figure 9:
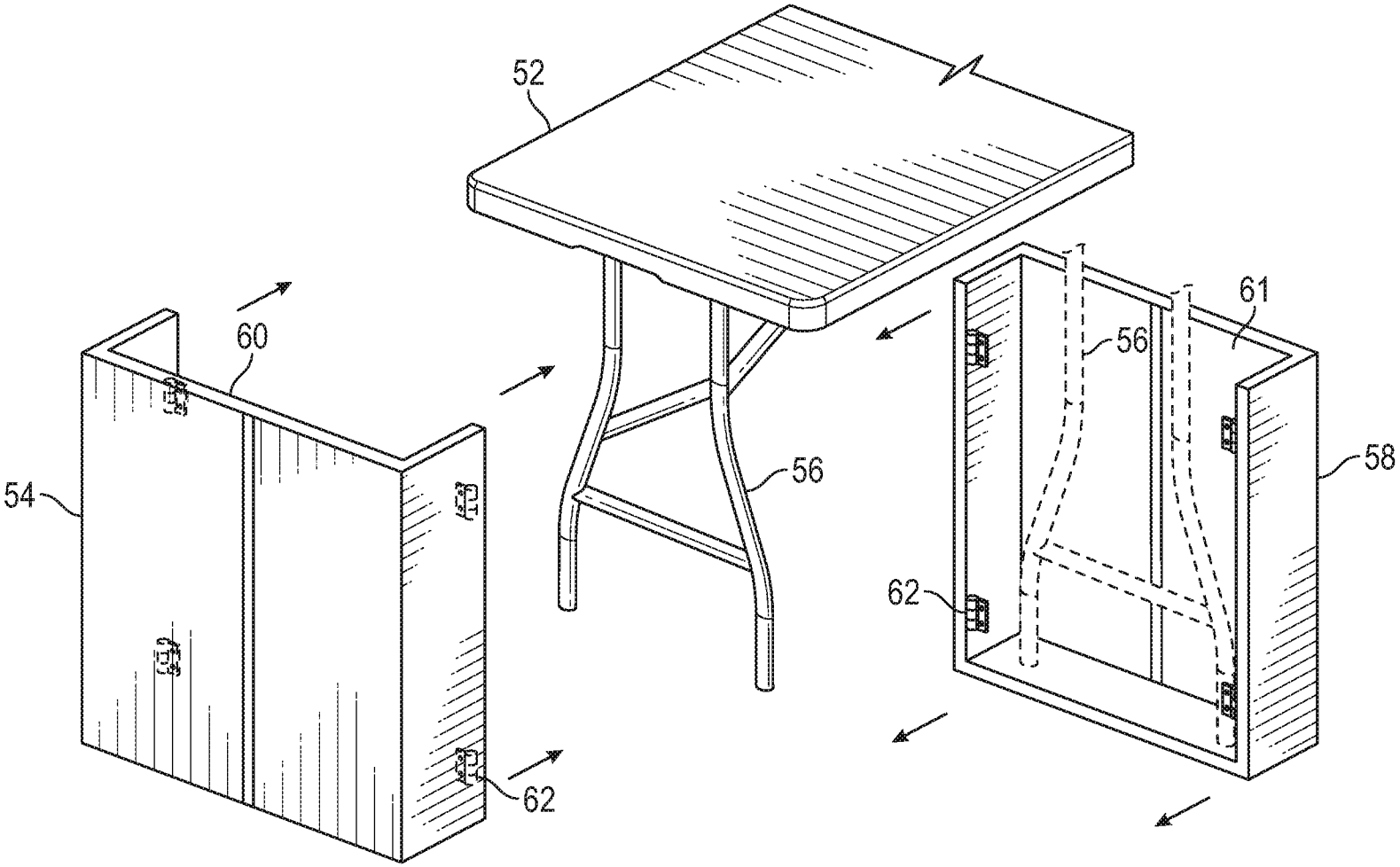
FIG. 9 is an implementation of the table leg apparatus in a box-frame configuration including hinges.

Referring to FIG. 9, an implementation of the table leg apparatus in a box-frame configuration including hinges is illustrated. The table leg apparatus includes a first portion 54, as illustrated. In various implementations, a plurality of recesses 60, 61, or cavities, of the first portion 54 and the second portion 58 may correspond to the shape of a table support 56 of a table 52. For exemplary purposes, a box-frame shape of the first portion 54 is illustrated in FIG. 9, though the recesses 60, 61 may correspond to any shape of first portion or table support. As illustrated, the recesses 60, 61 may be configured to receive the table support 56. In various implementations, the recesses 60, 61 may include braces, clips, fasteners, or other supports, by non-limiting example that may be configured to hold the table support 56 in place within the recesses 60, 61. As illustrated, a second portion 58 may be configured to removably couple over the first portion 54, by hinges 62 or by any of the means previously described, and the first portion 54 and the second portion 58 may fully or partially enclose the table support 56. In such implementations, the table leg apparatus may be one piece, the first portion 54 and the second portion 58 hingedly coupled together, and configured to surround and close around the table support 56. In still other implementations, the first portion 54 and the second portion 58 may be removable from one another.

Figure 10:
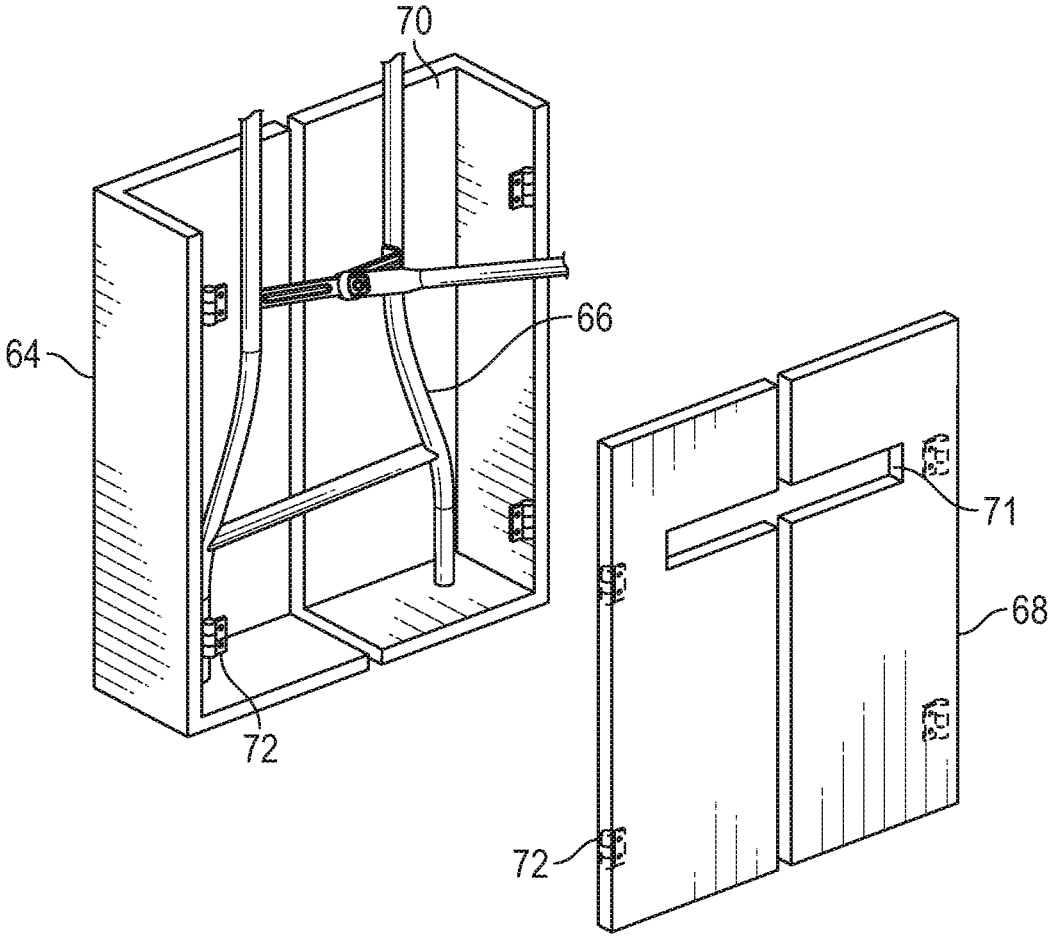
FIG. 10 is an alternative implementation of the table leg apparatus of FIG. 9, including a flat second portion.

Referring to FIG. 10, an alternative implementation of the table leg apparatus of FIG. 9, including a flat second portion, is illustrated. The table leg apparatus includes a first portion 64, as illustrated. In various implementations, a recess 70, or cavity, of the first portion 64 may correspond to the shape of a table leg support of a table. For exemplary purposes, a box-frame shape of the first portion 64 is illustrated in FIG. 10, though the recess 70 may correspond to any shape of front portion or table support. As illustrated, the recess 70 may be configured to receive the table support 66. As illustrated, a second portion 68 may be configured to removably couple over the first portion 64, by hinges 72 or by any of the means previously described, and the first portion 64 and the second portion 68 may fully or partially enclose the table support 66. In such implementations, the table leg apparatus may be one piece, the first portion 64 and the second portion 68 hingedly coupled together, and configured to surround and close around the table support 66. In still other implementations, the first portion 64 and the second portion 68 may be removable from one another. As illustrated, the second portion 68 is substantially flat, and includes one or more notches 71 configured to couple around the table support 66.

Figure 11:
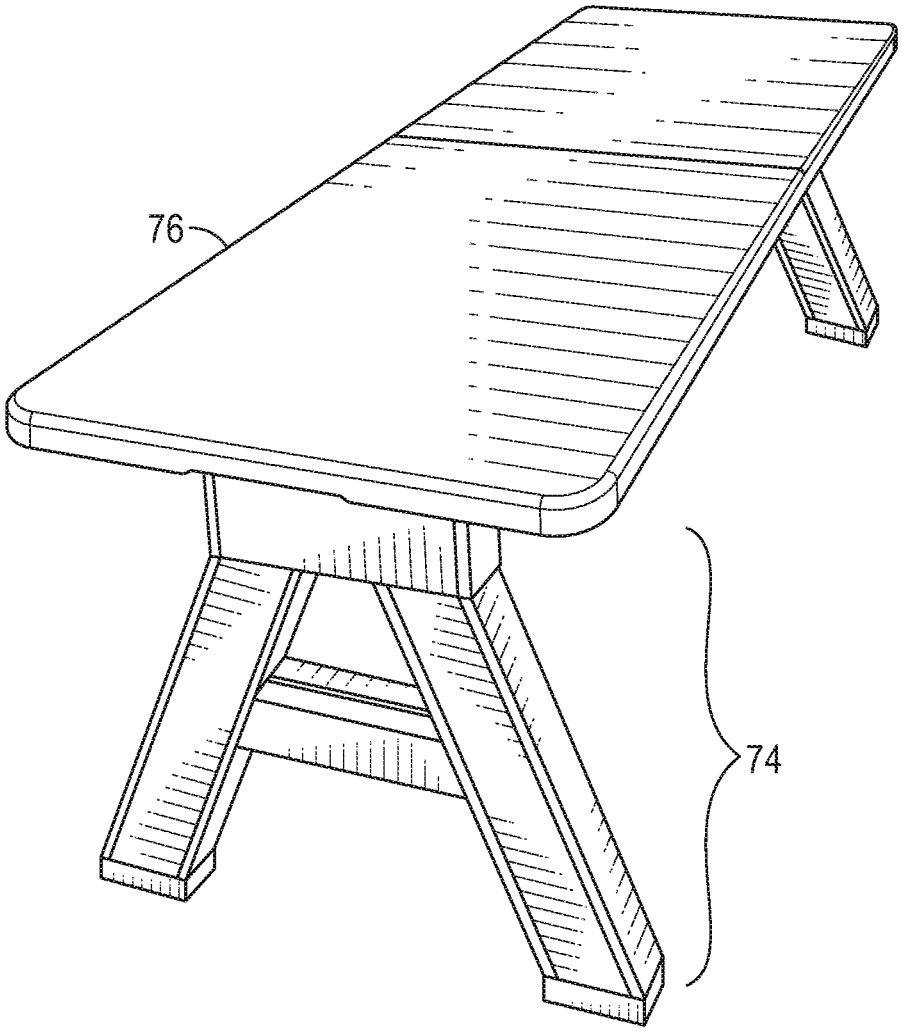
FIG. 11 is an implementation of the table leg apparatus, coupled onto a banquet table.

Referring to FIG. 11, an implementation of the table leg apparatus, coupled onto a banquet table, is illustrated. For exemplary purposes, a banquet table 76 is illustrated, though the table leg apparatus 74 may be used on any type of table. As illustrated, the table leg apparatus 74 encloses a table support of the table 76. In various implementations, the table leg apparatus 74 may be configured to removably couple, or readily attach and detach, from the table 76, to provide for ease of use of the table leg apparatus 74, and for ease of storage when the table leg apparatus 74 is not in use.

The table leg apparatus, as disclosed and described in this document, may be made of materials such as wood, wood veneer, plastic, metal, laminate, or any other such material, by non-limiting example. The table leg apparatus may be configured to accommodate or couple around folding or stationary table legs, and may be shaped according to the various shapes and structures of table legs that may be contemplated.

In places where the description above refers to particular implementations of attachable table leg apparatus and implementing components, sub-components, methods and sub-methods, it should be readily apparent that a number of modifications may be made without departing from the spirit thereof and that these implementations, implementing components, sub-components, methods and sub-methods may be applied to other attachable table leg apparatus.

What is claimed is:

1. A table leg apparatus comprising:

a first portion comprising a plurality of recesses, the plurality of recesses configured to receive a table support, the table support comprising a first table leg and a second table leg; and a second portion configured to removably couple over the first portion;

wherein the first portion and the second portion fully enclose the first table leg and the second table leg of the table support.

2. The apparatus of claim 1, further comprising a third portion configured to cover a bridge of the table support.

3. The apparatus of claim 1, wherein a location of the plurality of recesses of the first portion corresponds to a shape of the table support.

4. The apparatus of claim 3, wherein the shape of the table support is one of an A-frame, X-frame, H-frame, ladder-frame, or box-frame.

5. The apparatus of claim 3, wherein a shape of the second portion corresponds with a shape of the plurality of recesses of the first portion.

6. The apparatus of claim 1, wherein the second portion is configured to hingedly couple to the first portion.

7. The apparatus of claim 1, wherein the second portion is configured to removably couple to the first portion using a tongue and groove system.

8. A table leg apparatus comprising:

a first portion comprising a plurality of cavities, the plurality of cavities configured to receive a table support, the table support comprising a first table leg and a second table leg;

a first bottom portion configured to receive a first foot of the first table leg;

a second bottom portion configured to receive a second foot of the second table leg; and a second portion configured to removably couple over the first portion;

wherein the first portion and the second portion enclose the first table leg and the second table leg of the table support.

9. The apparatus of claim 8, further comprising a third portion configured to enclose a bridge of the table support.

10. The apparatus of claim 8, wherein a location of the plurality of cavities of the first portion corresponds to a shape of the table support.

11. The apparatus of claim 10, wherein the shape of the table support is one of an A-frame, X-frame, H-frame, ladder-frame, or box-frame.

12. The apparatus of claim 10, wherein a shape of the second portion corresponds with a shape of the plurality of cavities of the first portion.

13. The apparatus of claim 8, wherein the second portion is configured to hingedly couple to the first portion.

14. The apparatus of claim 8, wherein the second portion is configured to removably couple to the first portion using a tongue and groove system.

15. A table leg apparatus comprising:

a first portion comprising a plurality of recesses, the plurality of recesses configured to receive a table support, the table support comprising a first table leg and a second table leg; and a second portion comprising one or more notches, the one or more notches configured to couple around the table support;

wherein the second portion is configured to removably couple over the first portion; and wherein the first portion and the second portion fully enclose the first table leg and the second table leg of the table support.

16. The apparatus of claim 15, wherein a location of the plurality of recesses of the first portion corresponds to a shape of the table support.

17. The apparatus of claim 16, wherein the shape of the table support is one of an A-frame, X-frame, H-frame, ladder-frame, or box-frame.

18. The apparatus of claim 16, wherein a shape of the second portion corresponds with a shape of the plurality of recesses of the first portion.

19. The apparatus of claim 15, wherein the second portion is configured to hingedly couple to the first portion.

20. The apparatus of claim 15, wherein the second portion is configured to removably couple to the first portion using a tongue and groove system.

* * * * *